US006664038B2

(12) United States Patent
Ceruti et al.

(10) Patent No.: US 6,664,038 B2
(45) Date of Patent: Dec. 16, 2003

(54) PHOTOGRAPHIC ELEMENT HAVING IMPROVED SENSITOMETRY AND MECHANICAL RESISTANCE

(75) Inventors: Luca Ceruti, Savona (IT); Eva Genesio, Finale Ligure (IT); Gianluigi Molinari, Spotorno (IT); Ivo Zullo, Cairo Montenotte (IT)

(73) Assignee: Ferrania, S.p.A., Ferrania Savona (IT)

( * ) Notice: Subject to any disclaimer, the term of this patent is extended or adjusted under 35 U.S.C. 154(b) by 0 days.

(21) Appl. No.: 10/260,958

(22) Filed: Sep. 27, 2002

(65) Prior Publication Data

US 2003/0099911 A1 May 29, 2003

(30) Foreign Application Priority Data

Oct. 2, 2001 (IT) ..... SV2001A0032

(51) Int. Cl.[7] ..... G03C 1/047; G03C 1/30

(52) U.S. Cl. ..... 430/621; 430/639; 430/640; 430/641; 430/642

(58) Field of Search ..... 430/621, 640, 430/642, 567, 639, 641

(56) References Cited

U.S. PATENT DOCUMENTS

| | | | | |
|---|---|---|---|---|
| 4,746,594 A | * | 5/1988 | Kasama et al. | 430/264 |
| 5,019,494 A | * | 5/1991 | Toya et al. | 430/600 |
| 5,302,505 A | | 4/1994 | Delfino et al. | 430/567 |
| 5,370,986 A | | 12/1994 | Lok et al. | 430/607 |
| 5,374,509 A | | 12/1994 | Valentini | 436/536 |
| 5,529,892 A | | 6/1996 | Massirio et al. | 430/623 |

FOREIGN PATENT DOCUMENTS

| | | | |
|---|---|---|---|
| EP | 0 936 201 A2 | 8/1999 | C04B/24/10 |
| EP | 0 950 697 A1 | 10/1999 | C09D/17/00 |
| EP | 0 965 880 A1 | 12/1999 | G03C/1/04 |
| JP | 55-098745 | 7/1980 | G03C/1/74 |
| JP | 55-098746 | 7/1980 | G03C/1/74 |
| JP | 08-122956 | 5/1996 | G03C/1/08 |
| WO | WO 95/02614 | 1/1995 | C08B/37/00 |

* cited by examiner

*Primary Examiner*—Thorl Chea
(74) *Attorney, Agent, or Firm*—Mark A. Litman & Assoc. P.A.

(57) ABSTRACT

A silver halide emulsion which comprises silver halide grains dispersed in a hydrophilic colloid mixture comprising from 5% to 25% by weight of dextran, from 20% to 40% by weight of hydrogenated poly-saccharide having an average molecular weight equal to or lower than 10,000, and from 40% to 60% by weight of gelatin. A fore-hardened photographic material comprising such an emulsion and the use of such an emulsion in a photographic material increases the sensitometry and mechanical resistance of such a photographic material.

15 Claims, No Drawings

PHOTOGRAPHIC ELEMENT HAVING IMPROVED SENSITOMETRY AND MECHANICAL RESISTANCE

BACKGROUND OF THE INVENTION

1. Field of the Invention

The present invention relates to a silver halide photographic element. More particularly, the present invention relates to a silver halide photographic element for use in radiography having improved sensitometric results and mechanical resistance comprising a mixture of a gelatin derivative, a dextran and a hydrogenated polysaccharide.

2. Background of the Art

In recent years, there has been a strong demand for high sensitivity, low graininess and low fog in silver halide photographic elements as well as a capability for rapid processing in which development is expedited. Recently, the demands for performance by silver halide photographic light sensitive materials have become severe. In particular, demands for not only basic performance such as high sensitivity, low fog and superior graininess but also other measures of performance such as rapid processing, mechanical resistance and storage stability have become stronger than in the past.

In general, silver halide photographic light sensitive materials are subject to a variety of mechanical stresses that can have adverse effects upon the general performance of the photographic materials. A photographic film is subject to mechanical stresses in the manufacturing process thereof, or may be bent or abraded when being transported in the automatic processor. As well known in the art, when mechanical stresses are applied to the silver halide photographic material, changes in photographic performance are produced, and a technique for enhancing resistance to the effects of these mechanical stresses has been desired. The silver halide emulsions presently employed in photographic elements are more sensitive to mechanical stresses during automatic processing than older emulsions. There is the need to provide a photographic element having increased mechanical resistance without negatively affecting the high quality sensitometric properties provided by modern silver halide emulsions.

Several approaches have been attempted to solve this problem. Hardening of emulsion layers has been the more general approach described in a number of patent and patent applications, such as, for example, in U.S. Pat. Nos. 5,529,892 and 5,302,505. Another approach relates to the introduction of an intermediate gelatin layer interposed between the support and the emulsion layer, as described, for example, in U.S. Pat. No. 3,637,389.

Still another approach relates to the introduction of coating additives. For example, methods in which polymer latexes or plasticizers are included, methods in which the silver halide/gelatin ratio in the silver halide emulsion layer is reduced, and methods in which a lubricant or colloidal silica is added to the protective layer, are well known as means of improving the mechanical resistance of photographic elements. A description of useful coating aids can be found in Research Disclosure No. 38597, September 1996, "Photographic Silver Halide Emulsions, Preparations, Addenda, Systems and Processing", Item IX.

U.S. Pat. No. 5,374,509 describes a mixture of hydrophilic colloid, a branched polysaccharide, a polyacrylamide, a polyvinylidine chloride and a polyacrylate in a binder.

JP 08-0122956 describes a silver halide emulsion which contains a metal chelating agent (type tartaric acids, ethylene diamine tetraacetates, nitro triacetates, uramil diacetates) and a mono-, di- or poly-saccharide.

JP 55-098745 and JP 55-098746, describes polysaccharides having glucose units as main chain and mannose, fucose and glucoronic acids as side chain in photographic solution preparation for high speed coating and improved physical properties.

U.S. Pat. No. 5,370,986 describes the use of polyhydroxyalkyl stabiliser compounds and a co-stabilising agent in a silver chloride photographic element to prevent fog formation. The polyhydroxyalkyl stabiliser is a non-reducing oligosaccharide or its alkyl-substituted glycoside of formula $R—(CHOH)_n(CHOR_1)_m—Z$ with n=3–7, m=0–7, $R=R_1=H$ or 1–3C alkyl, Z=COOR' or CONR'R' and R'=1–3C alkyl.

WO 95-02614, EP 950,697, and EP 936,201 describe the preparation and use of hydrogenated polysaccharides for the preparation of mixtures with mineral binders, fillers and/or pigments.

EP 965,880 describes the use of hydrogenated polysaccharides in combination with aryl compound having at least two hydroxyl groups to increase the speed to Dmin ratio of a light-sensitive silver halide element.

SUMMARY OF THE INVENTION

A first aspect of the present invention relates to a silver halide emulsion which comprises silver halide grains dispersed in a hydrophilic colloid mixture, the hydrophilic colloid mixture comprising from 5% to 25% by weight of dextran, from 20% to 40% by weight of a hydrogenated polysaccharide having an average molecular weight equal to or lower than 10,000, and from 40% to 60% by weight of gelatin.

In another aspect, the present invention relates to a silver halide photographic element comprising a support, at least one silver halide emulsion layer coated on at least one side of said support, and at least one protective layer coated over said emulsion layer, said emulsion layer comprising silver halide grains dispersed in a hydrophilic colloid mixture, characterized in that said hydrophilic colloid mixture comprises from 5 to 25% by weight of dextran, from 20% to 40% by weight of a hydrogenated polysaccharide having an average molecular weight equal to or lower than 10,000, and from 40% to 60% by weight of gelatin and in that said photographic element is forehardened.

In yet another aspect the present invention relates to the use of a hydrophilic colloid mixture comprising from 5% to 25% by weight of dextran, from 20% to 40% by weight of a hydrogenated polysaccharide having an average molecular weight equal to or lower than 10,000, and from 40% to 60% by weight of gelatin to improve the sensitometry and the mechanical resistance of a silver halide photographic element.

DETAILED DESCRIPTION OF THE INVENTION

Accordingly, in one aspect the present invention relates to a silver halide emulsion which comprises silver halide grains dispersed in a hydrophilic colloid mixture, the hydrophilic colloid mixture comprising from 5% to 25% by weight of dextran, from 20% to 40% by weight of a hydrogenated polysaccharide having an average molecular weight equal to or lower than 10,000, and from 40% to 60% by weight of gelatin.

According to a preferred aspect of the present invention, the hydrophilic colloid mixture comprises from 10% to 20% by weight of dextran, from 25% to 35% by weight of a hydrogenated polysaccharide having an average molecular weight equal to or lower than 10,000, and from 45% to 55% by weight of gelatin.

Dextran is the generic name denoting many high molecular weight glucans predominantly composed of alpha-1→6 bonds as derivatized from sucrose by Leuconostoc mesenteroides and other organisms. Dextran is commercially available in a range of average molecular weight of from 3,000 to 500,000. A preferred range of average molecular weight to be used in the practice of the present invention is comprised between 5,000 and 50,000, more preferably from 10,000 to 25,000. Dextran derivatives include (1) carboxyalkyl dextrans (such as carboxymethyl dextran), (2) dialkyl aminoalkyl dextrans (such as diethyl aminoethyl dextran), and (3) amino dextrans.

For the purposes of the present invention, dextran is typically added in an amount of from 5 to 100 grams per mole of silver, preferably in the range of from 10 to 80 grams per mole of silver, more preferably from 20 to 40 grams per mole of silver. Some photographic elements are provided as 'two-sided' photographic elements in which a support has at least one silver halide emulsion layer on each side of the support. Such amounts of ingredients in the hydrophilic colloid mixture can be expressed in terms of grams per square meter per side of the resulting silver halide radiographic element, wherein the amounts above correspond to an amount of from about 0.1 to 2.0 g/m$^2$, preferably in the range of from 0.2 to 1.6 g/m$^2$, more preferably from 0.4 to 0.8 g/m$^2$ per side, respectively.

Hydrogenated polysaccharides having a recurring unit comprising five or six carbon atoms are preferably used in the present invention. Preferred recurring units include, for example, adonitol, arbitol, xylitol, dulcitol, iditol, mannitol, sorbitol, and the like. The average molecular weight of the hydrogenated polysaccharide derivatives used in the present invention is equal to or lower than 10,000, preferably lower than 8,000, and most preferably in the range of from 6,000 to 1,000.

Hydrogenated polysaccharides are commercially available, for example, under the trade designation Polysorb®, from Roquette, Lille, France. The preparation of hydrogenated polysaccharides usually starts from natural products (like starch, agar, tragacanth gum, xanthan gum, guar gum, and the like) by means of enzymatic processes (to reduce the average molecular weight) and of reducing processes (to saturate the molecule). Polysorb® hydrogenated polysaccharides useful in the present invention are listed below together with their respective CAS registration number.

| Commercial Name | CAS Registration Number |
|---|---|
| Polysorb ® AN 221-10/80 | 111092-73-0 |
| Polysorb ® P | 39317-78-7 |
| Polysorb ® RA 1000 | 204866-68-2 |
| Polysorb ® SI | 134633-92-4 |
| Polysorb ® 05/60 | 153130-95-1 |
| Polysorb ® 70/12/12 | 167140-15-0 |
| Polysorb ® 10B | 25086-67-3 |
| Polysorb ® 15/100 | 134688-45-2 |
| Polysorb ® 2 | 60976-39-8 |
| Polysorb ® 2-6 | 90955-13-8 |
| Polysorb ® 30/100 | 78690-76-3 |

-continued

| Commercial Name | CAS Registration Number |
|---|---|
| Polysorb ® 4 | 105287-50-1 |
| Polysorb ® 40/100 | 78690-77-4 |
| Polysorb ® 5 | 138726-47-3 |
| Polysorb ® 6 | 125148-17-6 |
| Polysorb ® 60/100 | 122525-49-9 |
| Polysorb ® 80/55 | 77466-50-3 |
| Polysorb ® 9 | 66593-04-2 |

For the purposes of the present invention, the hydrogenated polysaccharides described above is typically added in an amount of from 10 to 100 grams per mole of silver in the photographic silver halide component, preferably in the range of from 20 to 80 grams per mole of silver, more preferably from 40 to 60 grams per mole of silver. Such amounts can be expressed in terms of grams per square meter per side of the resulting silver halide radiographic element, wherein the amounts above correspond to an amount of from 0.2 to 2.0 g/m$^2$, preferably in the range of from 0.4 to 1.6 g/m$^2$, more preferably from 0.8 to 1.2 g/m$^2$ per side, respectively.

Gelatin is a hydrophilic colloid derived from animal collagen. Any gelatin made from animal collagen can be used, but gelatin made from pig skin, cow skin or cow bone collagen is preferable. The kind of gelatin is not specifically limited, but several kinds of gelatins, such as, for example, lime-processed gelatin, acid processed gelatin, amino group inactivated gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or gelatin derivatives, such as, for example, gelatin derivatives disclosed in JP Patent Publications 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and GB Patents 861,414 and 103,189 can be used singly or in combination. Preferably, gelatin derivatives include highly deionized gelatin, acetylated gelatin and phthalated gelatin.

For the purposes of the present invention, gelatin is typically added in an amount of from 50 to 200 grams per mole of silver, preferably in the range of from 75 to 150 grams per mole of silver, more preferably from 80 to 120 grams per mole of silver in the photographic silver halide component. Such amounts can be expressed in terms of grams per square meter per side of the resulting silver halide radiographic element, wherein the amounts above correspond to an amount of from about 0.9 to 3.6 g/m$^2$, preferably in the range of from 1.3 to 2.7 g/m$^2$, more preferably from 1.5 to 2.2 g/m$^2$ per side, respectively.

The silver halide emulsion of the present invention can be prepared either directly conducting the formation and growth of silver halide grains into the above described hydrophilic colloid mixture or, preferably, by first conducting the formation and growth of silver halide grains in gelatin and then adding the proper amounts of dextran and hydrogenated saccharide to get the silver halide emulsion of the present invention. In the latter case, the addition of dextran and hydrogenated saccharide can be done at any time before the coating of the silver halide emulsion. The term "any time before the coating" means after the emulsion-making step, before, during or after the chemical and optical sensitization step, or just before coating step. More preferably, the addition of dextran and hydrogenated saccharide is conducted just before coating step.

Silver halide emulsions according to the present invention can be prepared using conventional methods, including a single-jet method, a double-jet method, or a combination of these methods and can be ripened using, for instance, an ammonia method, a neutralization method, or an acid method. Parameters which may be adjusted to control grain growth include pH, pAg, temperature, shape and size of reaction vessel, and the reaction method (e.g., accelerated or constant flow rate precipitation, interrupted precipitation, ultrafiltration during precipitation, reverse mixing processes and combinations thereof). A silver halide solvent, such as ammonia, thioethers, thioureas, etc., may be used, if desired, for controlling grain size, grain structure, particle size distribution of the grains, and the grain-growth rate. Methods for preparing silver halide emulsions are generally known to those skilled in the art and can be found in references such as Trivelli and Smith, *The Photographic Journal*, Vol. LXXIX, May 1939, pp. 330–338, T. H. James, *The Theory of The Photographic Process,* 4th Edition, Chapter 3, *Chimie et Physique Photographique*, P. Glafkides, Paul Montel (1967), *Photographic Emulsion Chemistry*, G. F. Duffin, The Focal Press (1966), *Making and Coating Photographic Emulsions*, V. L. Zelikman, The Focal Press (1966), in U.S. Pat. Nos. 2,222,264; 2,592,250; 3,650,757; 3,917,485; 3,790,387; 3,716,276; and 3,979,213; *Research Disclosure*, September 1994, Item 36544 "Photographic Silver Halide Emulsions, Preparations, Addenda, Systems and Processing."

In the preparation of silver halide emulsions, halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions with silver bromoiodide compositions containing from 0 to 10 mol % silver iodide, preferably, from 0.2 to 5 mol % silver iodide, and more preferably, from 0.5 to 1.5 mol % silver iodide. The halogen composition of individual grains may be homogeneous or heterogeneous.

The silver halide grains of these emulsions may be coarse or fine, and the grain size distribution of them may be narrow or extensive. Further, the silver halide grains may be regular grains having a regular crystal structure such as cube, octahedron, and tetradecahedron, or a spherical or irregular crystal structure, or those having crystal defects such as twin planes, or those having a tabular form, or combination thereof. Furthermore, the grain structure of the silver halides may be uniform from the interior to exterior thereof, or be multilayer. In one embodiment, the grains may comprise a core and a shell, in which each may have different halide compositions and/or may have undergone different modifications such as the addition of doping agents. Besides having a differently composed core and shell, the silver halide grains may also comprise different phases in-between. Furthermore, the silver halides may be of such a type as allows a latent image to be formed mainly on the surface thereof or of such type as allows it to be formed inside the grains thereof. Grains with epitaxial growth may also be used in the practice of the invention.

In a preferred embodiment of the present invention, tabular silver halide emulsions are employed. Tabular silver halide emulsions are characterized by the average diameter:thickness ratio (i.e., aspect ratio) of silver halide grains. Tabular silver halide grains have an aspect ratio of at least 2:1, preferably, 2:1 to 20:1, more preferably, 2:1 to 14:1, and most preferably, 2:1 to 8:1. Average diameters of the tabular silver halide grains range from about 0.3 to about 5 mm, preferably, from about 0.5 to about 3 mm, more preferably, from about 0.8 to about 1.5 mm. The tabular silver halide grains have a thickness of less than 0.4 mm, preferably, less than 0.3 mm, and more preferably, within 0.1 to 0.3 mm. The projected area of the tabular silver halide grains accounts for at least 50%, preferably, at least 80%, and more preferably, at least 90% of the projected area of all the silver halide grains of the emulsion.

The tabular silver halide grain dimensions and characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain, a diameter:thickness ratio of each grain can be calculated, and the diameter:thickness ratios of all tabular grains can be averaged to obtain their average diameter:thickness ratio. In other words, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the method used, the average diameter:thickness ratios obtained do not greatly differ.

At the end of the silver halide grain formation, water soluble salts are removed from the emulsion by procedures known in the art. Suitable washing processes are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

Among the known techniques for removing the dispersing medium and soluble salts while retaining silver halide grains in the remaining dispersion, ultrafiltration is a particularly advantageous washing process. Typically, an ultrafiltration unit comprising membranes of inert, non-ionic polymers is used as a washing process. Since silver halide grains are large in comparison with the dispersing medium and the soluble salts or ions, silver halide grains are retained by the membranes while the dispersing medium and the soluble salts dissolved therein are removed.

Prior to use, silver halide grain emulsions are generally fully dispersed and subjected to any of the known methods for achieving a desired sensitivity. A wide description of methods and compounds useful in chemical and optical sensitization can be found in Research Disclosure No. 38597, September 1996, "Photographic Silver Halide Emulsions, Preparations, Addenda, Systems and Processing", Items IV and 5.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. Tabular silver halide grains, after grain formation and desalting, are preferably chemically sensitized by at least one gold sensitizer and at least one sulfur sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature of preferably 40° C. or more for a predetermined period of time. As a gold sensitizer, any gold compound which has an oxidation number of +1 or +3 and is normally used as gold sensitizer can be used. Preferred examples of gold sensitizers are chloroauric acid, the salts thereof and gold complexes, such as those described in U.S. Pat. No. 2,399,083. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

Sulfur sensitization is performed by adding a sulfur sensitizer to the silver halide emulsion and stirring the emulsion at a high temperature of 40° C. or more for a predetermined period of time. Useful examples of sulfur sensitizer include thiosulfonates, thiocyanates, sulfinates, thioethers, and elemental sulfur.

The amounts of the gold sensitizer and the sulfur sensitizer change in accordance with the various conditions, such as activity of the gold and sulfur sensitizer, type and size of silver halide grains, temperature, pH and time of chemical ripening. These amounts, however, are preferably from 1 to 20 mg of gold sensitizer per mole of silver, and from 1 to 100 mg of sulfur sensitizer per mole of silver. The temperature of chemical ripening is preferably 45° C. or more, and more preferably 50° C. to 80° C. The pAg and pH may take arbitrary values.

During chemical sensitization, addition times and order of gold sensitizer and sulfur sensitizer are not particularly limited. For example, gold and sulfur sensitizers can be added at the initial stage of chemical sensitization or at a later stage either simultaneously or at different times. Usually, gold and sulfur sensitizers are added to the silver halide emulsion by their solutions in water, in a water-miscible organic solvent, such as methanol, ethanol and acetone, or as a mixture thereof.

A stabilizer is preferably added at any time before the addition of the sulfur sensitizer. While not intending to be bound by any particular theory, it is believed that it acts as a digest stabilizer and a site director for the sulfur sensitizer. Preferably, the stabilizer is added before the addition of sulfur chemical sensitizer in an amount of from 1 to 500 milligrams per mole of silver, preferably, from 10 to 300 milligrams per mole of silver.

Specific examples of useful stabilizers include thiazole derivatives; benzothiazole derivatives; mercapto-substituted heterocyclic compounds (e.g., mercaptotetrazoles, mercaptotriazoles, mercaptodiazoles, mercaptopyrimidines, mercaptoazoles); azaindenes, (e.g., triazaindenes and tetrazaindenes); triazoles; tetrazoles; and sulfonic and sulfinic benzene derivatives. Azaindenes are preferably used, more preferably, tetraazaindenes.

A silver halide grain emulsion may be optically sensitized to a desired region of the visible spectrum. Suitable methods for spectral sensitization are known. For example, optical sensitization may be achieved by using an optical sensitizer, such as a cyanine dye, a merocyanine dye, complex cyanine and a merocyanine dye, an oxonol dye, a hemioxonol dye, a styryl dye and a streptocyanine dye, or a combination thereof. Useful optical sensitizers include cyanines derived from quinoline, pyridine, isoquinoline, benzindole, oxazole, thiazole, selenazole, imidazole. Particularly useful optical sensitizers are the dyes of the benzoxazole-, benzimidazole- and benzothiazole-carbocyanine type. Typically, the addition of the spectral sensitizer is performed after the completion of chemical sensitization. Alternatively, spectral sensitization can be performed concurrently with chemical sensitization, before chemical sensitization, or even prior to the completion of silver halide precipitation. When the spectral sensitization is performed before the chemical sensitization, it is believed that the preferential absorption of spectral sensitizing dyes on the crystallographic faces of the tabular grains allows chemical sensitization to occur selectively at unlike crystallographic surfaces of the tabular grains. In a preferred embodiment, the spectral sensitizers produce J aggregates, if adsorbed on the surface of the silver halide grains, and a sharp absorption band (J-band) with a bathochromic shift with respect to the absorption maximum of the free dye in aqueous solution.

It is known in the art of radiographic photographic elements that the intensity of the sharp absorption band (J-band) shown by the spectral sensitizing dye absorbed on the surface of the light-sensitive silver halide grains will vary with the quantity of the specific dye chosen as well as the size and chemical composition of the grains. The maximum intensity of J-band has been obtained with silver halide grains having the above described sizes and the chemical compositions absorbed with J-band spectral sensitizing dyes in a concentration of from 25 to 100 percent or more of monolayer coverage of the total available surface area of the silver halide grains. Optimum dye concentration levels can be chosen in the range of 0.5 to 20 millimoles per mole of silver halide, preferably, in the range of 2 to 10 millimoles.

Spectral sensitizing dyes producing J aggregates are known in the art, such as described by F. M. Hamer, *Cyanine Dyes and Related Compounds*, John Wiley and Sons, 1964, Chapter XVII and by T. H. James, *The Theory of the Photographic Process,* 4th Edition, MacMillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphthoxazolium, naphthothiazolium and naphthoselenazolium quaternary salts.

Suitable cyanine dyes, which are joined by a methine linkage, include two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituent groups.

Suitable merocyanine dyes, which are joined by a methine linkage, include a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin-4-one.

The methine spectral sensitizing dyes are generally known in the art, such as those described in U.S. Pat. Nos.

2,503,776; 2,912,329; 3,148,187; 3,397,060; 3,573,916; and 3,822,136 and FR Pat. No. 1,118,778. Also their use in photographic emulsions is known, wherein they are used in optimum concentrations corresponding to desired values of sensitivity to fog ratios. Optimum or near optimum concentrations of spectral sensitizing dyes generally go from 10 to 500 mg per mole of silver, preferably, from 50 to 200, and more preferably, from 50 to 100.

Spectral sensitizing dyes can be used in combinations which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, *Photographic Science and Engineering,* 18, pp. 418–430, 1974 and in U.S. Pat. Nos. 2,933,390; 3,635,721; 3,743,510; 3,615,613; 3,615,641; 3,617,295; and 3,635,721.

Other additives can be added to the silver halide emulsion before or during coating, such as, stabilizers or antifoggants (i.e., azaindenes, triazoles, tetrazoles, imidazolium salts, polyhydroxy compounds and others); developing promoters (e.g., benzyl alcohol, polyoxyethylene type compounds, etc.); image stabilizers (i.e., compounds of the chromane, cumaran, bisphenol type, etc.); and lubricants (i.e., wax, higher fatty acids glycerides, higher alcohol esters of higher fatty acids, etc.). Also, coating aids, modifiers of the permeability in the processing liquids, defoaming agents, antistatic agents and matting agents may be used. Other useful additives are disclosed in *Research Disclosure*, Item 17643, December 1978 in *Research Disclosure*, Item 18431, August 1979, in *Research Disclosure*, Item 308119, Section IV, December 1989, and in *Research Disclosure* Item 36544, September 1994.

The silver halide emulsion is then coated on a support to form the photographic element of the present invention. Suitable supports include glass, paper, polyethylene-coated paper, metals, polymeric film such as cellulose nitrate, cellulose acetate, polystyrene, polyethylene terephthalate, polyethylene, polypropylene and the like. A preferred support is polyethylene terephthalate.

Preferred light-sensitive silver halide photographic elements are radiographic light-sensitive elements employed in X-ray imaging comprising a silver halide emulsion layer(s) coated on both surfaces of a support. The silver halide emulsions are preferably coated on the support at a silver coverage in the range of 1.5 to 3 g/m$^2$ per side, more preferably of from 1.5 to 2.5 g/m$^2$ per side.

Usually, the radiographic light-sensitive elements are associated with intensifying screens so as to be exposed to radiation emitted by the screens. Preferable intensifying screens are made of relatively thick phosphor layers which transform the X-rays into more imaging-effective radiation such as light (e.g., visible light). In operation, the screens absorb a larger portion of X-rays than the light-sensitive elements do and are used to reduce the X-ray dose necessary to obtain a useful image. Intensifying screens absorbing more than 25% of the total X-radiation are preferably used. Depending on their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes absorbed on the surface of the silver halide grains as described above.

Photographic elements of the present invention can include other layers and additives, such as subbing layers, surfactants, filter dyes, intermediate layers, protective layers, anti-halation layers, barrier layers, dye underlayers, development inhibiting compounds, speed-increasing agents, stabilizers, plasticizers, chemical sensitizers, UV absorbers and the like. Dye underlayers are particularly useful to reduce the cross-over of the double coated silver halide photographic element. Reference to well-known dye underlayer can be found in U.S. Pat. Nos. 4,900,652; 4,855,221; 4,857,446; and 4,803,150. In a preferred embodiment, a dye underlayer is coated on at least one side of the support, more preferably, on both sides of the support, before the coating of at least two silver halide emulsions.

The silver halide photographic elements of the present invention are fore-hardened. Typical examples of organic or inorganic hardeners include chrome salts (e.g., chrome alum, chromium acetate), aldehydes (e.g., formaldehyde and glutaraldehyde), carbamoyl pyridinium compounds (1-(N, N-Diethyl carbamoyl)-4-(2-sulfoethyl)pyridine), isocyanate compounds (hexamethylene diisocyanate), active halogen compounds (e.g., 2,4-dichloro-6-hydroxy-s-triazine), epoxy compounds (e.g., tetramethylene glycol diglycidylether), N-methylol derivatives (e.g., dimethylolurea, methyloldimethyl hydantoin), aziridines, mucohalogeno acids (e.g., mucochloric acid), compounds having at least one active vinyl group (e.g., vinylsulfonyl and hydroxy-substituted vinylsulfonyl derivatives) and the like. Other references to well known hardeners can be found in *Research Disclosure*, December 1989, Vol. 308, Item 308119, Section X, and *Research Disclosure*, September 1994, Vol. 365, Item 36544, Section II(b). The more useful hardeners have a quick action and migrate easily through the several layers of the photographic element during its coating. The hardener can be added to any layer of the photographic element of the present invention. The hardener is preferably added to the protective layer in an amount effective to fore-harden the resulting photographic element. Preferred hardness values (measured as described hereinbelow) are higher than 20, more preferably higher than 30, and most preferably higher than 40. Typical amounts of hardener added to the photographic element of the present invention are in the range of from 10 to 100 mg/m$^2$, the specific and preferred amounts also depending on the chemical nature of the hardener.

A detailed description of photographic elements and of various layers and additives can be found in *Research Disclosure* 17643 December 1978, *Research Disclosure* 18431 August 1979, *Research Disclosure* 18716 November 1979, *Research Disclosure* 22534 January 1983, *Research Disclosure* 308119 December 1989, and *Research Disclosure* 36544, September, 1994. The present invention will be now described in greater detail with reference to the following but not limiting examples. Various modifications and alterations of this invention will become apparent to those skilled in the art without departing from the scope and spirit of this invention. It should be understood that this invention is not to be unduly limited to the illustrative embodiments set forth herein.

All the amounts referred to in the following examples are relative to one mole of silver in the resulting silver halide emulsion, unless differently specified. All amounts are referred to one side.

EXAMPLES 1 TO 5

A silver bromoiodide emulsion was prepared using a conventional double jet method using 89.5 g of gelatin. The silver bromoiodide grains of the resulting emulsion had an average equivalent diameter of 1.20 micron, an average grain thickness of 0.22 micron, a coefficient of variation (COV) of 40% and 0.9 percent iodide in mole/mole respect to the total halide ions. The COV is a coefficient indicating the width of the grain size distribution curve and can be defined by the following formula:

$$COV=(\text{Grain Standard Deviation}/\text{Grain Average Diameter})*100$$

The emulsion was chemically and spectrally sensitized using conventional sulfur, gold, and palladium sensitizers plus a triethyl ammonium salt of 5,5'-dichloro-9-ethyl-3,3'-di-(3-sulfopropyl) oxacarbocyanine as spectral sensitization dye. The digestion was performed for about 120 to 150 minutes at 60°. The emulsion was successively stabilized with 200 mg of potassium iodide and 1366 mg of 5-methyl-7-hydroxy-2-3-4-triazoindolizine (4-hydroxy-6-methyl-1,3,3a,7-tetraazaindene) before chilling and kept in cold storage until needed for coating.

The sensitized silver halide emulsion was melted at 45° C. and subjected to coating finals. As coating auxiliaries were added 1.37 g of calcium nitrate, 50 mg of azodicarboxylic dimorpholide, 19.87 g of polyethylacrylate (in dispersion at 30% in water), 260 mg of Colanyl blue and 53 mg of Flexonyl violet as chromatic correctors, the amount of dextran (CAS No. 9004-54-0) reported in Table 1, and the amount of hydrogenated polysaccharide commercially available under the trade designation Polysorb® 70/12/12 (CAS No. 167140-15-0), from Roquette Frères, Lille, France reported in Table 1. Finally, the pH was corrected to 6.5.

The resulting silver halide emulsion was immediately coated on the two sides of blue 7 mil polyester base with a conventional antistatic top-coat based on gelatin (1.19 g/m$^2$) containing surfactants (11 mg/m$^2$ of Niaproof™, the trade name of an anionic surfactant of the alkane sulfate type, 42 mg/M$^2$ of Zonyl® FSN100, the trade name of a non-ionic perfluoroalkylpolyoxyethylene surfactant, and 12 mg/m$^2$ of lauric acid diethanolamide), matting agents (75 mg/m$^2$ of polymethylmethacrylate particles), and an amount of hardening agent (1,3-bisvinylsulfonyl-2-propanol, unless differently indicated) as reported in Table 1. The resulting silver covering weight was adjusted around about two grams per square meter as reported in the following Table 2.

The fresh film samples were kept 3 days at 38° C. before being subjected to X-ray exposure using an X-ray tube at 70 Kilovolts and 160 Milliamperes for 0.1 second with two green emitting screens commercially available under the trade designation LifeRay™ medium screen manufactured by Ferrania S.p.A., Italy.

The exposed films were processed through a 90 second dry to dry medical X-ray automatic processor type XP-515 (manufactured by Ferrania S.p.A., Italy) with commercially available chemistry (LifeRay™ XAD-3 developer and Liferay™ XAF-3 fixer, both from Ferrania S.p.A., Italy or Kodak RP X-Omat™ developer and fixer).

The sensitometric results and processing mark evaluation are reported in Table 2 below. The hardness was measured 24 hours after the coating with an instrument provided with a sapphire stylus subject to a variable weight as described in ANSI PH1.37-1977. The sample was prepared by imbibing it with water at 20° C. for 5 minutes. Afterthat, the sample was put in the instrument and the length L (expressed in mm) of the incision obtained with a weight W (expressed in grams) was measured. The hardness values (Hv) were obtained by applying the following formula: Hv=(120-L)*W/160. The higher the hardness value, the harder the material. Processing mark evaluation was the average score (from 1, worst, to 10, the best) of three evaluations by different observer for scraps or other marks on the radiographic film surface after processing.

TABLE 1

| | Hardener mg/m$^2$ | Polysorb ® g/m$^2$ | Dextran g/m$^2$ | Gelatin g/m$^2$ | Polysorb % w/w | Dextran % w/w | Gelatin % w/w |
|---|---|---|---|---|---|---|---|
| 1 | 64.3 | 0.113 | 1.572 | 1.955 | 3.1 | 43.2 | 53.7 |
| 2 | 49.8 | 0.559 | 1.038 | 1.843 | 16.3 | 30.2 | 53.6 |
| 3 | 26.7 | 1.081 | 0.408 | 1.693 | 34.0 | 12.8 | 53.2 |
| 4 | 15.3 | 1.270 | 0.129 | 1.585 | 42.6 | 4.3 | 53.1 |
| 5 | 9.6 | 1.424 | — | 1.606 | 47.0 | — | 53.0 |

TABLE 2

| | Dmin (2) | Dmax (2) | Speed (2) | Speed (1) | Ag g/m$^2$ | Hardness | Processing marks |
|---|---|---|---|---|---|---|---|
| 1 | 0.222 | 4.04 | 2.28 | 2.26 | 2.355 | 25 | 10 |
| 2 | 0.215 | 3.82 | 2.32 | 2.27 | 2.22 | 37 | 10 |
| 3 | 0.204 | 3.31 | 2.34 | 2.30 | 2.04 | 48 | 8.1 |
| 4 | 0.206 | 3.31 | 2.39 | 2.35 | 1.91 | 40 | 6.2 |
| 5 | 0.206 | 3.62 | 2.39 | 2.40 | 1.935 | 27 | 5.5 |

(1) LifeRay ™ Developer XAD-3 and Fixer XAF-3
(2) Kodak RP X-Omat ™ Developer and Fixer Samples 1 and 1 having a lower amount of Polysorb® and a higher amount of dextran showed optimal results in terms of processing marks, but poorer sensitometric and physiological results. Samples 4 and 5 having a higher amount of Polysorb® and a lower amount of dextran showed optimal sensitometric results, but undesirable results in terms of processing marks.

Sample 3 of the present invention showed optimal sensitometric results still maintaining good results in term of processing marks. This shows that the unique balance of components recited in the practice of the invention provides an unexpected result based on the narrow range of materials described.

EXAMPLES 6 TO 10

The procedure of samples 1 to 5 was repeated by using the amounts of Polysorb®, dextran gelatin and hardener reported in Table 3. The sensitometric results and processing mark evaluation are reported in Table 4 together with the silver covering weight values.

TABLE 3

| | Hardener mg/m$^2$ | Polysorb ® g/m$^2$ | Dextran g/m$^2$ | Gelatin g/m$^2$ | Polysorb % w/w | Dextran % w/w | Gelatin % w/w |
|---|---|---|---|---|---|---|---|
| 6 | 26.7 | 1.041 | 0.393 | 1.631 | 34.0 | 12.8 | 53.2 |
| 7 | 21.6 | 1.057 | 0.399 | 1.656 | 34.0 | 12.8 | 53.2 |
| 8 | 15.9 | 1.052 | 0.397 | 1.648 | 34.0 | 12.8 | 53.2 |
| 9 | 10.8 | 1.034 | 0.390 | 1.619 | 34.0 | 12.8 | 53.2 |
| 10 | 9.6 | 1.479 | — | 1.668 | 47.0 | — | 53.0 |

TABLE 4

| | Dmin (1) | Dmax (1) | Speed (1) | Speed (2) | Ag g/m$^2$ | Hardness | Processing marks |
|---|---|---|---|---|---|---|---|
| 6 | 0.224 | 3.27 | 2.40 | 2.38 | 1.965 | 48 | 7.5 |
| 7 | 0.230 | 3.34 | 2.41 | 2.39 | 1.995 | 43 | 7.4 |
| 8 | 0.227 | 3.52 | 2.43 | 2.43 | 1.985 | 34 | 6.8 |
| 9 | 0.229 | 3.90 | 2.46 | 2.46 | 1.95 | 24 | 6.8 |
| 10 | 0.215 | 3.68 | 2.43 | 2.47 | 2.01 | 25 | 5.5 |

(1) LifeRay ™ XAD-3 Developer and XAF-3 fixer
(2) Kodak RP X-Omat ™ Developer and Fixer This set of experiments was performed to evaluate the effect of different amount of hardener on the invention. By comparing samples 6 to 9 having decreasing amount of hardener, it can be noted that the effect of the invention are maintained, even if best results are obtained with samples 6 and 7. The inventive effect disappeared in sample 10 (compared to sample 9) where the percentage of dextran and Polysorb® was outside the range of the invention.

EXAMPLES 11 TO 16

The procedure of sample 1 to 5 was repeated by using the amounts of Polysorb®, dextran, gelatin and hardener reported in Table 5. The sensitometric results and processing mark evaluation are reported in Table 6 together with the silver covering weight values.

TABLE 5

| | Hardener mg/m$^2$ | Polysorb ® g/m$^2$ | Dextran g/m$^2$ | Gelatin g/m$^2$ | Polysorb ® % w/w | Dextran % w/w | Gelatin % w/w |
|---|---|---|---|---|---|---|---|
| 11 | 22.5 | 1.158 | 0.727 | 1.814 | 31.3 | 19.6 | 49.0 |
| 12 | 20.4 | 1.169 | 0.733 | 1.830 | 31.3 | 19.6 | 49.0 |
| 13 | 18.0 | 1.153 | 0.723 | 1.805 | 31.3 | 19.6 | 49.0 |
| 14* | 11.1 | 1.145 | 0.718 | 1.793 | 31.3 | 19.6 | 49.0 |
| 15** | 42.0 | 1.163 | 0.730 | 1.822 | 31.3 | 19.6 | 49.0 |
| 16** | 33.5 | 1.153 | 0.723 | 1.805 | 31.3 | 19.6 | 49.0 |

*formaldehyde hardener
**1-(N,N-Diethyl carbamoyl)-4-(2-sulfoethyl)pyridine hardener

TABLE 6

| | Dmin (1) | Dmax (1) | Speed (1) | Speed (2) | Ag/m$^2$ g | Hardness | Processing marks |
|---|---|---|---|---|---|---|---|
| 11 | 0.212 | 3.7 | 2.4 | 2.38 | 2.185 | 45 | 8.1 |
| 12 | 0.21 | 3.67 | 2.41 | 2.37 | 2.205 | 43 | 8.1 |
| 13 | 0.214 | 3.75 | 2.42 | 2.39 | 2.175 | 40 | 8.1 |
| 14 | 0.219 | 3.57 | 2.42 | 2.38 | 2.16 | 46 | 7.5 |
| 15 | 0.213 | 3.88 | 2.45 | 2.43 | 2.195 | 37 | 7.5 |
| 16 | 0.211 | 3.67 | 2.45 | 2.42 | 2.175 | 42 | 7.5 |

(1) LifeRay ™ XAD-3 Developer and XAF-3 fixer
(2) Kodak RP X-Omat ™ Developer and Fixer This set of experiments was performed to evaluate the effect of different hardeners on the invention. The results demonstrated that the advantages of the invention were maintained with different hardeners.

What is claimed is:

1. A silver halide emulsion comprising silver halide grains dispersed in a hydrophilic colloid mixture, characterized in that said hydrophilic colloid mixture comprises from 5% to 25% by weight of dextran, from 20% to 40% by weight of hydrogenated poly-saccharide having an average molecular weight equal to or lower than 10,000, and from 40% to 60% by weight of gelatin.

2. The silver halide emulsion of claim 1, characterized in that said hydrophilic colloid mixture comprises from 10% to 20% by weight of dextran, from 25% to 35% by weight of hydrogenated polysaccharide having an average molecular weight equal to or lower than 10,000, and from 45% to 55% by weight of gelatin.

3. The silver halide emulsion of claim 1, characterized in that said hydrophilic colloid mixture comprises at least one dextran in an amount of from 5 to 100 grams per mole of silver, at least one hydrogenated polysaccharide in an amount of from 10 to 100 grams per mole of silver, and gelatin in an amount of from 50 to 200 grams per mole of silver.

4. The silver halide emulsion of claim 1, characterized in that said hydrophilic colloid mixture comprises at least one dextran in an amount of from 10 to 80 grams per mole of silver, at least one hydrogenated polysaccharide in an amount of from 20 to 80 grams per mole of silver, and gelatin in an amount of from 75 to 150 grams per mole of silver.

5. The silver halide emulsion of claim 1, characterized in that said hydrophilic colloid mixture comprises at least one dextran in an amount of from 20 to 40 grams per mole of silver, at least one hydrogenated polysaccharide in an amount of from 40 to 60 grams per mole of silver, and gelatin in an amount of from 80 to 120 grams per mole of silver.

6. A silver halide photographic element comprising a support, at least one silver halide emulsion layer coated on at least one side of said support, and at least one protective layer coated over said emulsion layer, said emulsion layer comprising silver halide grains dispersed in a hydrophilic colloid mixture, characterized in that said hydrophilic colloid mixture comprises from 5% to 25% by weight of dextran, from 20% to 40% by weight of hydrogenated polysaccharide having an average molecular weight equal to or lower than 10,000, and from 40% to 60% by weight of gelatin and in that said photographic element is fore-hardened.

7. The silver halide photographic element of claim 6, characterized in that said hydrophilic colloid mixture comprises from 10% to 20% by weight of dextran, from 25% to 35% by weight of hydrogenated polysaccharide having an average molecular weight equal to or lower than 10,000, and from 45% to 55% by weight of gelatin.

8. The silver halide photographic element of claim 6, characterized in that said photographic element shows a hardness value higher than 20.

9. The silver halide photographic element of claim 6, characterized in that said photographic element shows a hardness value higher than 30.

10. The silver halide photographic element of claim 6, characterized in that said photographic element is fore-hardened with at least one hardener selected from the group consisting of chrome salts, carbamoyl pyridinium compounds, isocyanate compounds, active halogen compounds, epoxy compounds, N-methylol derivatives, aziridines, mucohalogeno acids, and compounds having at least one active vinyl group.

11. The silver halide photographic element of claim 10, characterized in that said hardener is added in an amount of from 10 to 100 mg/m$^2$ of said emulsion layer.

12. The silver halide photographic element of claim 6, characterized in that said hydrophilic colloid mixture comprises at least one dextran in an amount of from 5 to 100 grams per mole of silver, at least one hydrogenated polysaccharide in an amount of from 10 to 100 grams per mole of silver, and gelatin in an amount of from 50 to 200 grams per mole of silver.

13. The silver halide photographic element of claim 6, characterized in that said hydrophilic colloid mixture comprises at least one dextran in an amount of from 10 to 80 grams per mole of silver, at least one hydrogenated polysaccharide in an amount of from 20 to 80 grams per mole of silver, and gelatin in an amount of from 75 to 150 grams per mole of silver.

14. The silver halide photographic element of claim 6, characterized in that said hydrophilic colloid mixture comprises at least one dextran in an amount of from 20 to 40 grams per mole of silver, at least one hydrogenated polysaccharide in an amount of from 40 to 60 grams per mole of silver, and gelatin in an amount of from 80 to 120 grams per mole of silver.

15. A method for improving the sensitometry and the mechanical resistance of a silver halide photographic element comprising combining a silver halide emulsion with a hydrophilic colloid mixture comprising from 5% to 25% by weight of dextran, from 20% to 40% by weight of hydrogenated polysaccharide having an average molecular weight equal to or lower than 10,000, and from 40% to 60% by weight of gelatin.

* * * * *